US009396849B1

(12) United States Patent
Wyatt et al.

(10) Patent No.: US 9,396,849 B1
(45) Date of Patent: Jul. 19, 2016

(54) RESISTOR AND METHOD OF MANUFACTURE

(71) Applicant: Vishay Dale Electronics LLC, Columbus, NE (US)

(72) Inventors: Todd Wyatt, Columbus, NE (US); Clark Smith, Columbus, NE (US); Rod Brune, Columbus, NE (US); Rocky Klabunde, Columbus, NE (US)

(73) Assignee: VISHAY DALE ELECTRONICS LLC, Columbus, NE (US)

( * ) Notice: Subject to any disclaimer, the term of this patent is extended or adjusted under 35 U.S.C. 154(b) by 3 days.

(21) Appl. No.: 14/203,234

(22) Filed: Mar. 10, 2014

(51) Int. Cl.
*H01C 1/142* (2006.01)
*H01C 17/06* (2006.01)
*H01C 7/00* (2006.01)

(52) U.S. Cl.
CPC . *H01C 17/06* (2013.01); *H01C 7/00* (2013.01)

(58) Field of Classification Search
CPC .... H01C 1/1406; H01C 17/006; H01C 17/16; H01C 17/242; H01C 17/28; H01C 17/288; H01C 1/034; H01C 1/144; H01C 1/148; H01C 1/16; H01C 7/02; H01C 7/021; H01C 7/027; H01C 7/18
USPC ..... 338/327, 195, 309, 313, 332, 254
See application file for complete search history.

(56) References Cited

U.S. PATENT DOCUMENTS 4,707,909 A 11/1987 Blanchard
4,759,836 A 7/1988 Hill et al.
4,920,388 A 4/1990 Blanchard et al.
5,287,083 A 2/1994 Person et al.
5,604,477 A 2/1997 Rainer et al.
6,103,095 A 8/2000 Chakravorty
6,401,329 B1 6/2002 Smejkal et al.
6,690,083 B1 2/2004 Mitchell et al.
6,819,615 B1 11/2004 Fastow et al.
6,883,889 B2 4/2005 Mackenzie et al.
7,118,273 B1 10/2006 Schnaitter
7,339,410 B1 3/2008 Farrenkopf
7,378,937 B2 5/2008 Tsukada
8,242,878 B2 8/2012 Smith et al.
8,590,141 B2 11/2013 Hirano et al.

*Primary Examiner* — Kyung Lee

(57) ABSTRACT

The present technology is directed toward a resistor and method of manufacturing the resistor. One or more layers of insulative material are formed on a length of resistive material. Portions of the one or more layers insulative material are removed from the resistive material in a pattern based on a predetermined approximate dimension and predetermined approximate resistance value. A first set of one or more conductive layers are formed on the portions of the resistive material exposed by the insulative coating to form a plurality of conductive pads on the resistive material between the patterned insulative material. The sets of conductive pads are probed to measure a preliminary resistance value between the sets of conductive pads. For one or more sets of conductive pads, a calculated amount of additional insulative material adjacent the respective conductive pads is removed based upon the preliminary resistance value between the corresponding set of conductive pads and a final resistance value to exposed additional portions of resistive material. The conductive pads and resistive material is cut at substantially the middle of each conductive pad to form pieces. A second set of one or more conductive layers are formed on the first set of one or more conductive layers at opposing ends of each piece, and the additionally exposed portions of the resistive material.

15 Claims, 9 Drawing Sheets

RESISTOR AND METHOD OF MANUFACTURE

BACKGROUND OF THE INVENTION

Surface mount resistors are widely utilized in electronic devices. One common type of surface mount resistor is the metal strip resistor. A surface mount metal strip resistor may have a value that ranges between 100 micro-Ohms (μΩ) and 10 Ohms (Ω). One exemplary, but non-limiting, use of low ohmic value surface mount metal strips resistors is in current sensing applications. In such applications, the ohmic value of the resistor needs exhibit a relatively precise value.

Conventional techniques for manufacturing surface mount metal strip resistors with relatively precise ohmic values typically suffer from low material utilization, complex manufacturing processes, and the like. Therefore, there is a continuing need for improved manufacturing techniques for surface mount metal strip resistors exhibiting a relatively tight tolerance in their ohmic value.

SUMMARY OF THE INVENTION

The present technology may best be understood by referring to the following description and accompanying drawings that are used to illustrate embodiments of the present technology directed toward resistors and methods of manufacturing the resistors.

In one embodiment, a method of manufacturing resistors includes coating a resistive material with one or more layers of insulative material. Portions of the insulative material are then removed from the resistive material in a pattern based on a predetermined approximate dimension and predetermined approximate resistance value. A first set of one or more conductive layers are deposited on the portions of the resistive material exposed by the patterned insulative material to form a plurality of conductive pads. A resistance between each set of conductive pads is measured and then a calculated amount of additional insulative material adjacent to the corresponding conductive pads is removed based upon the measured resistance between each set of conductive pads. A second set of one or more conductive layers are then deposited on the first set of one or more conductive layers and the additional exposed portions of the resistive material.

In another embodiment, each resistor includes resistive material, and insulative material disposed on the resistive material between terminations of the resistor. The resistive material has a predetermined resistivity. The insulative material has a substantially uniform thickness and is disposed on a first region of the resistive material. The terminations are disposed at opposing ends of the resistive material. The terminations include a first set of one or more conductive layers disposed on a second region of the resistive material, and a third region of the resistive material at an opposing end from the second region of the resistive material. The terminations also include a second set of one or more conductive layers disposed on the first set of one or more conductive layers, on a fourth region of the resistive material between the insulative material and the first set of one or more conductive layers on the second region of the resistive material, and on a fifth region of the resistive material between the insulative material and the first set of one or more conductive layers on the third region of the resistive material at the opposing end from the second region of the resistive material.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE DRAWINGS

Embodiments of the present technology are illustrated by way of example and not by way of limitation, in the figures of the accompanying drawings and in which like reference numerals refer to similar elements and in which.

DETAILED DESCRIPTION OF THE INVENTION

Reference will now be made in detail to the embodiments of the present technology, examples of which are illustrated in the accompanying drawings. While the present technology will be described in conjunction with these embodiments, it will be understood that they are not intended to limit the invention to these embodiments. On the contrary, the invention is intended to cover alternatives, modifications and equivalents, which may be included within the scope of the invention as defined by the appended claims. Furthermore, in the following detailed description of the present technology, numerous specific details are set forth in order to provide a thorough understanding of the present technology. However, it is understood that the present technology may be practiced without these specific details. In other instances, well-known methods, procedures, components, and circuits have not been described in detail as not to unnecessarily obscure aspects of the present technology.

In this application, the use of the disjunctive is intended to include the conjunctive. The use of definite or indefinite articles is not intended to indicate cardinality. In particular, a reference to "the" object or "a" object is intended to denote also one of a possible plurality of such objects. It is also to be understood that the phraseology and terminology used herein is for the purpose of description and should not be regarded as limiting.

Figure 1:
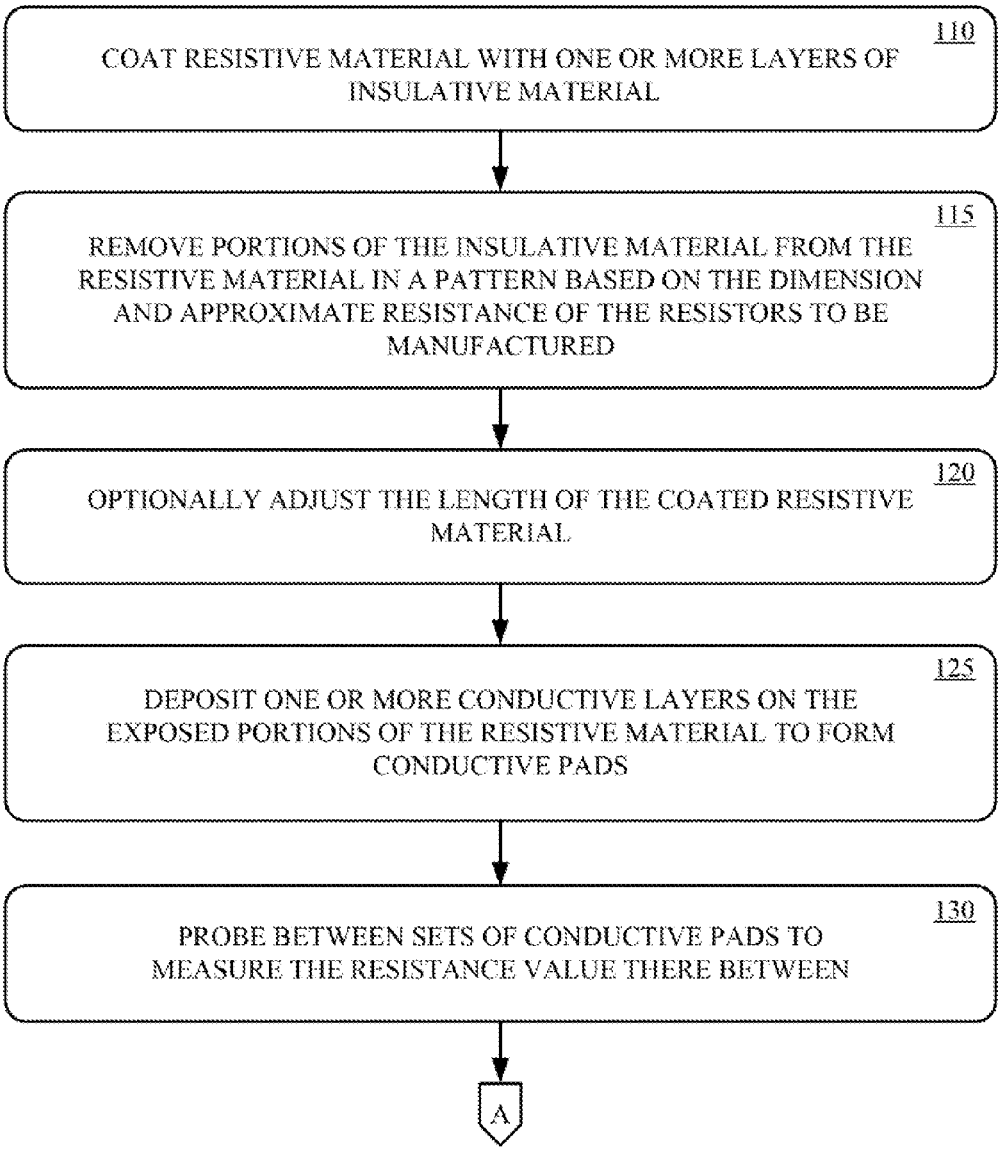
FIGS. 1 and 2 show a flow diagram of a method of manufacturing a resistor, in accordance with embodiments of the present technology.
Figure 2:
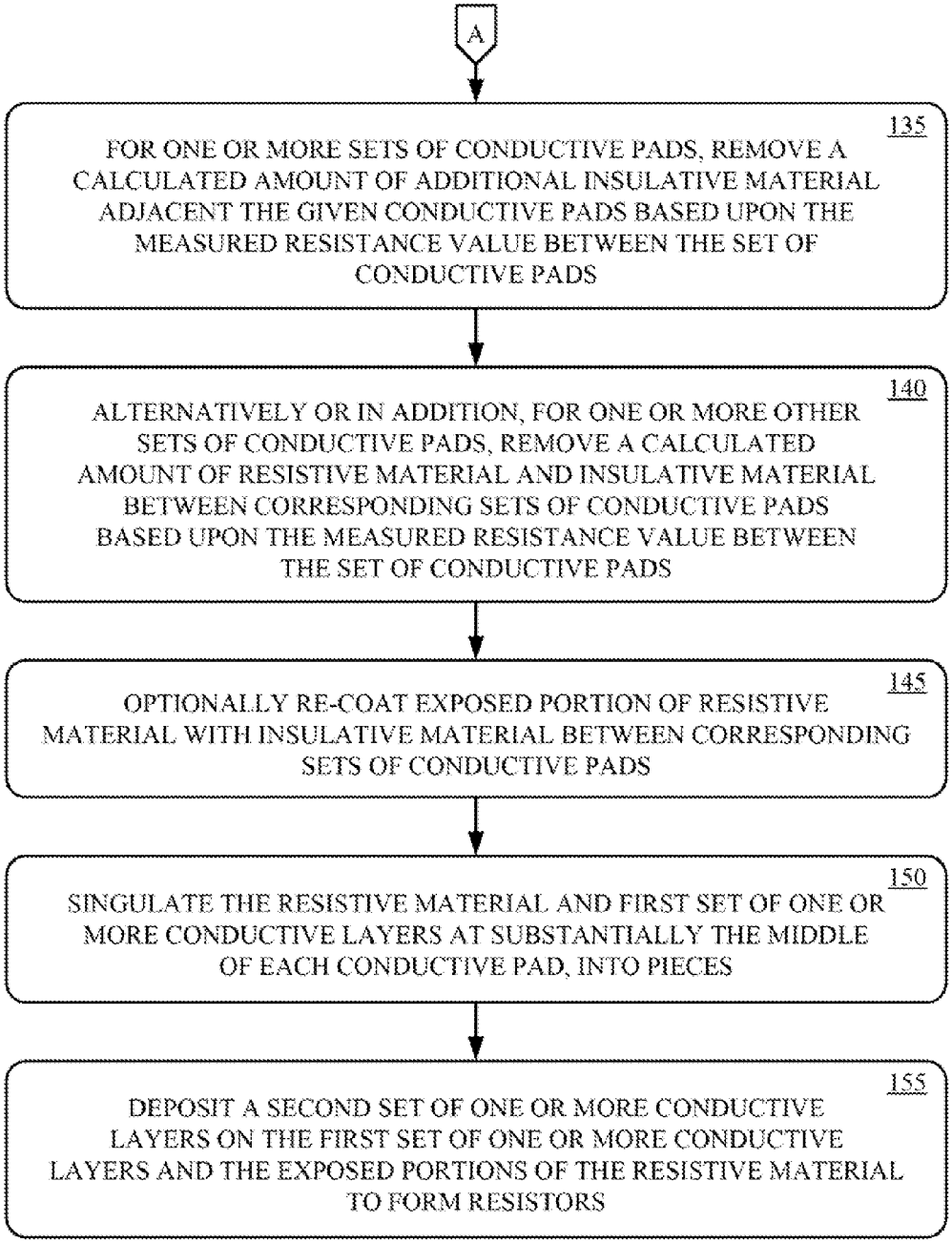
Figure 3:
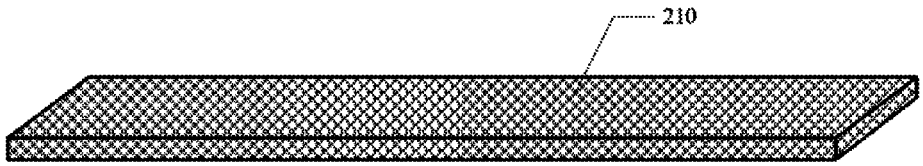
FIGS. 3-12 show perspective views at various stages of manufacturing of the resistor, in accordance with embodiments of the present technology.

Referring to FIGS. 1 and 2, a method of manufacturing a resistor, in accordance with embodiments of the present technology, is shown. The method of manufacturing the resistor will be further explained with reference to FIGS. 3-12, which show perspective views at various stages of manufacturing of the resistor. Although the method is illustrated in FIGS. 3-12 with respect to a few resistors fabricated from a length of resistive material 210, as shown in FIG. 3, tens of resistors to millions of resistors may be fabricated in accordance with the techniques described herein from a single length of resistive material.

Figure 4:
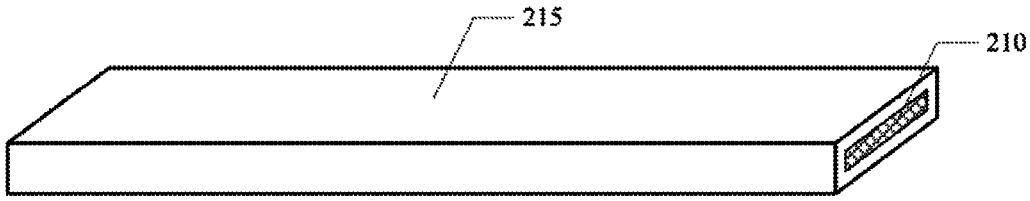

The method begins with coating a resistive material 210 with one or more layers of insulative material 215, at 110, as illustrated in FIG. 4. The resistive material 210 may be any appropriate conductors including metals or metal alloys such as nickel-chromium (NiCr), nickel-chromium-aluminum (NiCrAl), Copper-Magnesium (CuMn), or the like. The resistive material 210 is selected based upon a desired resistivity for the resistors to be produced. The resistive material 210 may also be selected based upon a desired temperature coefficient of resistivity, stability under load, and or the like.

The resistive material 210 may have a given form factor having a predetermined cross section (e.g., thickness and width). The form factor of the resistive material 210 may have any desired length. In one embodiment, the initial length of the resistive material 210 may be on the order of tens to thousands of resistors to be produced from each length (e.g., a stick). In another embodiment, the initial length of resistive material 210 may be on the order of thousands to hundreds of millions of resistors to be produced from each length (e.g., a spool). The form factor of the resistive material 210 may be produced by any appropriate process such as slitting flat wire or ribbon wire, or by flattening a round wire to a desired cross sectional dimension.

The resistive material 210 is coated on all four lengthwise sides with one or more insulative materials 215, as illustrated in FIG. 4. The insulative material 215 has a substantially uniform thickness along one or more lengthwise sides of the resistive material 210. The insulative material 215 may be any appropriate electrical insulator, such as silicon polyester, epoxy, polyimide, enamel, or the like. The insulative material 215 is selected to have good adhesion to the resistive material 210. The insulative material 215 is also selected to be removable in any of the following described processes. In one embodiment, the selected insulative material 215 is readily removable from the resistive material 210, by laser etching, abrasive machining, photolithography, or the like. The insulative material 215 may also be selected based upon any desired environmental insulator property (e.g., chemical).

Figure 5:
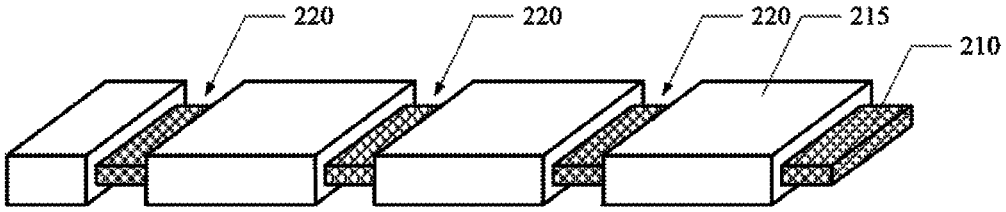

At 115, portions of the insulative material 215 are removed 220 from the resistive material 210 in a pattern selected based on the approximate dimensions and approximate resistance of resistor to be manufactured, as illustrated in FIG. 5. The approximate dimension may be a base size of a resistor package. The approximate resistance may be a base resistor value. The insulative material 215 may be removed 220 from the top surface, bottom surface (side to be mounted facing a printed circuit board), side surfaces of the resistive material 210 or any combination thereof. In one embodiment, the insulative material 215 is selectively removed 220 in a pattern to expose portions of the resistive material 210 from all sides approximately twice as wide as the desired terminal of the resistors to be manufactured and spaced apart by remaining portions of the coating of insulative material 215 approximately as wide as a desired length to provide a desired resistance value (e.g., length multiplied by resistivity per cross sectional area) of the resistor to be manufactured. In another embodiment, the portion of the top surface exposed may be smaller than the portion of the bottom surface of the resistive material 210 that is exposed. In yet another embodiment, portions of the bottom surface of the resistive material 210 may be exposed while the top surface remains covered by the insulative material 215. The coating of insulative material 215 may be selectively removed by any appropriate process, such as laser etching, abrasive machining, photolithography, or the like.

Optionally, if the resistive material 210 is in a long continuous length (e.g., spool), the resistive material 210 may be shortened into stick lengths before or after selectively removing portions of the insulative material 215, at 120. For example, it may be preferred to coat the resistive material 210 on all sides in one continuous process and then selectively remove portions of the coating of insulative material 215 while the resistive material 210 is in a spool. It may then be preferred to perform the additional processes described herein on sticks of the coated 215 resistive material 210. Shortening the length of the resistive material, for example from a spool to a plurality of sticks, for subsequent processing may provide for improving manufacturability (e.g., cost, quality control, and or the like) of the resistors.

Figure 6:
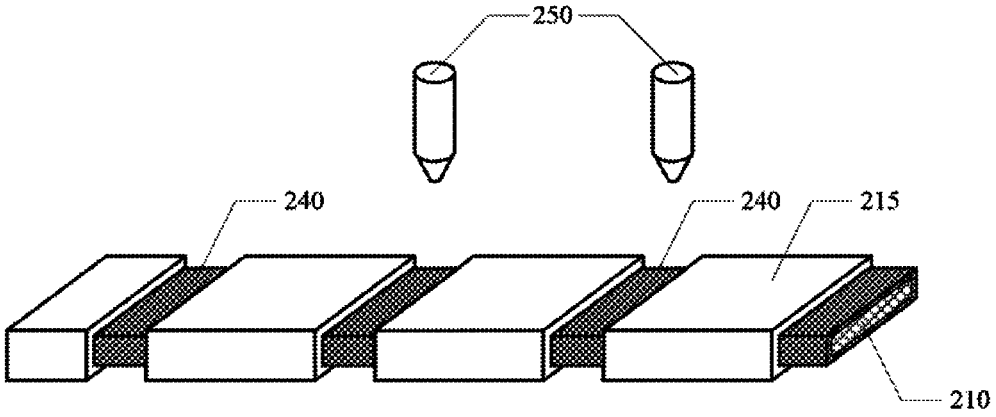

At 125, one or more conductive layers may be deposited on the exposed portions of the resistive material to form a plurality of conductive pads 240, as illustrated in FIG. 6. The one or more conductive layers may be any combination of metals and/or metal alloys. The conductive layers may be deposited by any appropriate process, such as sputtering, plating or the like. The coating of insulative material 215 remaining on the resistive material 210 may be used as a mask during depositing of the conductive pads 240. In one embodiment, a first layer of copper-titanium-tungsten (CuTiW) is sputtered on the resistive material and then a second layer of copper (Cu) is sputtered on the CuTiW layer. The CuTiW layer is selected to provide good adhesion between the resistive material and the copper platting. The initial resistance values of the resistors are defined by the length of the insulative material 215 on the resistive material 210 between each set of conductive pads 240.

At 130, sets of conductive pads 240 are probed to measure the resistance value there between. In one embodiment, the resistive material 210 between each pair of adjacent conductive pads 240 is probed to determine a preliminary resistance value of each corresponding resistor to be manufactured. In other embodiments, the resistive material 210 between every second, third, fourth or more conductive pads 240 may be probed. In one implementation, the resistance value between each set of conductive pads 240 may be measured by an appropriate test apparatus via a set of probes 250, as illustrated in FIG. 6.

Figure 7:
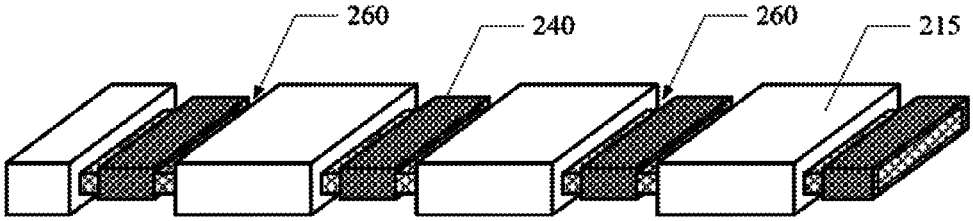

At 135, a calculated amount of additional insulative material is removed 260 adjacent to one or more sets of conductive pads 240 based upon the corresponding measured resistance value. Additional resistive material 210 is exposed between the conductive pads 240 and the remaining insulating material 215, as illustrated in FIG. 7. The additional insulative material 215 removed 260 is the amount that will result in a reduced resistor length between respective conductive pads 240 necessary to achieve the predetermined resistance value there between when one or more additional conductive layers are applied to the portion of the resistive material 210 exposed by the removed 260 additional insulative material 215. The additional insulative material 215 may be removed 260 by any of one or more appropriate technique that provides for sufficiently accurate removal of the calculated amount. For example, the additional insulative material 215 may be removed 260 by laser etching, abrasive etching, mechanical machining, chemical etching, or the like. The additional insulative material 215 may also be removed 260 by a combination of methods such as laser sensitization which allows a chemical etchant to work on only the sensitized portion.

Figure 8:
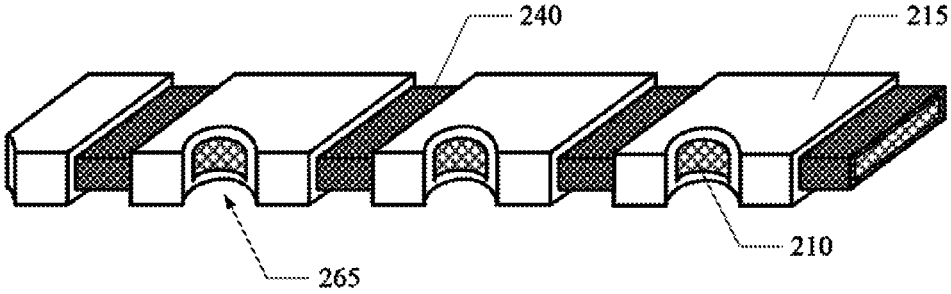

Alternatively, a calculated amount of a section of resistive material 210 and a section of the coating of insulative material 215 thereon may be removed 265 between one or more sets of conductive pads 240 based upon the measured resistance value, at 140, as illustrated in FIG. 8. The section of resistive material 210 removed 265 increases the resistance to the predetermined value due to the resistor width being effectively reduced. The corresponding section of the insulative material 215 and the section of the resistive material 210 may be removed 265 by any of one or more appropriate techniques including laser machining, mechanical removal or the like.

Figure 9:
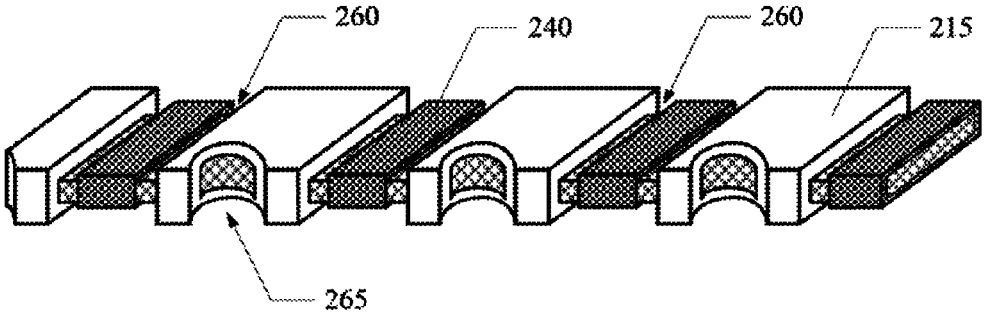

In other embodiments, the processes of reducing the resistance value by removing 260 an additional portion of the insulative material 215 adjacent to the sets of conductive pads 240 and increasing the resistance value by removing a section 265 of the resistive material 210 between corresponding sets of conductive pads 240 may be combined to achieve the predetermined resistance value, as illustrated in FIG. 9. For example, the process of removing 265 a section of the resistive material 210 between corresponding sets of conductive pads 240 may be used to increase the resistance value up to a predetermined range. Thereafter, the process of removing 260 an additional portion of the insulative material 215 adjacent to the sets of conductive pads 240 may be used to reduce the resistance value down to a final predetermined value.

Figure 10:
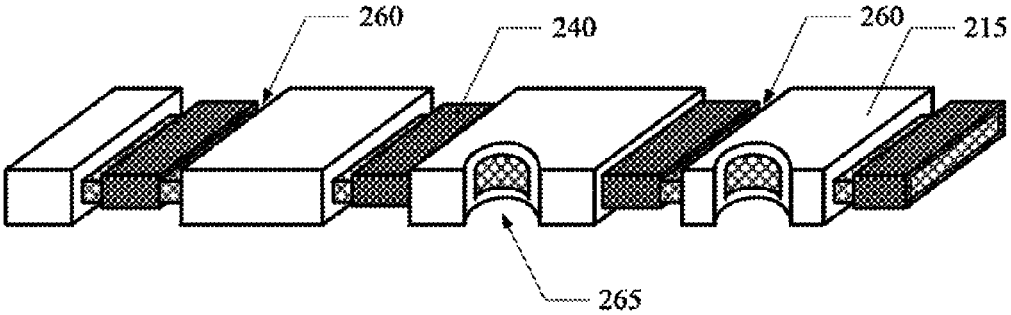

The processes of reducing the resistance value and increasing the resistance value may be combined in any order or number of steps. For example, both processes could be used along the same length of resistive material 210, but not both on the same resistor, where the resistor values are centered at the nominal value and some need to be increased in value while other resistors need to be reduced in value, as illustrated in FIG. 10. In addition, one or more pieces along the length of the resistive material 210 may not have any adjustment made if the measured preliminary resistance is equal to the predetermined final resistance value.

Figure 11:
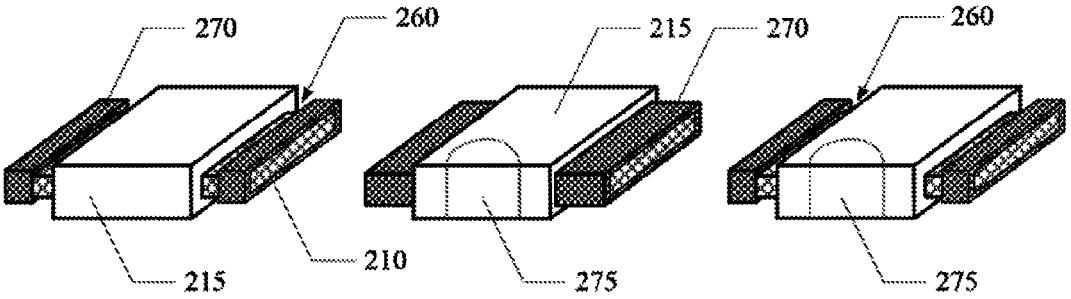

If the optional process of removing 265 a section of the resistive material 210 and corresponding section of the insulative material 215 between corresponding set of preliminary terminations 240 is utilized, the exposed surface of the resistive material 210 may be re-insulated with an insulative material 275, at 145, as illustrated in FIG. 11. Any appropriate insulative material 215 may be used to re-insulate the exposed section of resistive material 210. The insulative material 215 used in re-insulating may be the same or a different insulative material than used at 110.

Also illustrated in FIG. 11, the resistive material 210 with patterned insulative material 215 and conductive pads 240 may be singulated into individual pieces, at 150. The pieces may be singulated by cutting through the conductive pads 240 and resistive material 210 substantially in the middle of each conductive pad 240. Each resulting piece includes a first region of resistive material 210 covered by insulative material 215, a second region of resistive material 210 with a first portion of conductive pad 270 formed thereon, and a third portion of resistive material 210 with a second portion of conductive pad 270 formed thereon at an opposing end from the first portion of conductive pad 270. One or more individual pieces may also include exposed forth and fifth portions of resistive material 210 between the first portion of resistive material 210 covered by insulative material 215 and the second portion of resistive material 210 with the first portion of conductive pad 270 formed thereon, and between the first portion of resistive material 210 covered by insulative material 215 and the third portion of resistive material 210 with the second portion of conductive pad 270 formed thereon. One or more individual pieces may also include an area of the first region of resistive material 210 that has a section that has been removed and then re-insulated 275. One or more individual pieces may also include both a first region of resistive material 210 that has a section that has been removed and then re-insulated 275, and exposed forth and fifth region of resistive material 210. Alternatively, the process of singulating may be preformed earlier in the series of manufacturing processes, such as before the processes at 130, 135, or 140.

Figure 12:
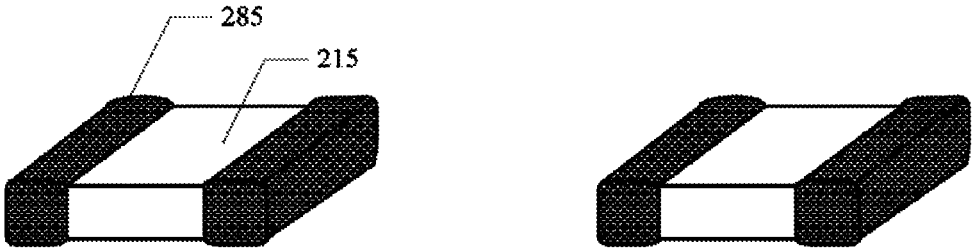

At 155, a second set of one or more additional conductive layers may be deposited to form terminations 285 at opposing ends of each piece. The second set of one or more additional conductive layers 285 are deposited over the first and second portions of the conductive pads 270. If applicable, the second set of one or more conductive layers may also be deposited on the exposed 260 resistive material 210 between the each of first and second portions of the conductive pads 270 and the remaining insulating material 215, as illustrated in FIG. 12. The one or more conductive layers may be any combination of metals and/or metal alloys. The one or more conductive layers may be deposited by any appropriate process, such as sputtering, plating or the like. In one embodiment, each piece may be plated with one or more additional conductive layers. In one embodiment, a first layer of plating, such as copper, may provide good adhesion to the first and second portions of the contact pads 270 and the adjacent exposed portions of resistive material 210. A layer of nickel (Ni) plating may be applied over the copper plating. A layer of tin (Tn) plating providing a solderable contact may be applied over the nickel plating. Any appropriate plating technique, such as barrel plating, spouted bed electrode plating, or the like may be utilized. Other metals may be used to coat the final terminations 285, such as gold for wire bonding, or adhesive bonding.

Figure 13:
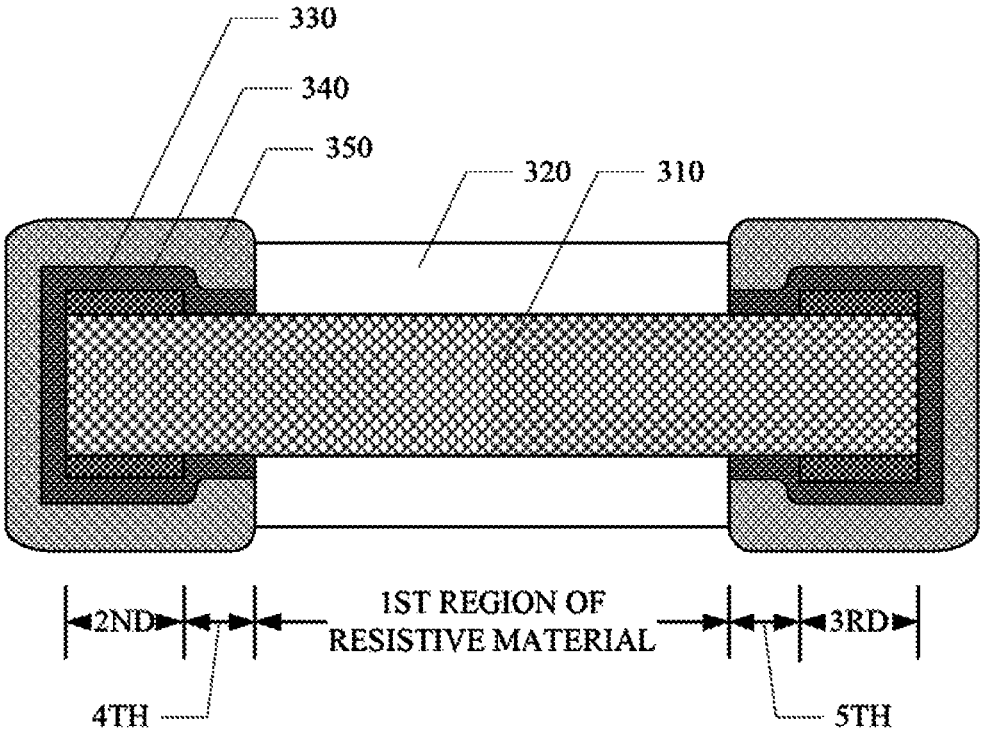
FIG. 13 shows a cross section view of a resistor, in accordance with embodiments of the present technology.

Referring now to FIG. 13, a cross-sectional view of a resistor, in accordance with embodiments of the present technology, is shown. The resistor includes a resistive material 310 having predetermined resistivity. The resistive material 310 has predetermined dimensions. The resistive material 310 may be, for example, nickel-chromium (NiCr), nickel-chromium-aluminum (NiCrAl), Copper-Magnesium (CuMn), or the like. An insulative material 320 having a substantially uniform thickness is disposed on a first region of the resistive material 310. The insulative material 320 may be, for example, silicon polyester, epoxy, polyimide, enamel, or the like. Terminations are disposed at opposing ends of the resistive material 310. The terminations include a first set of one or more conductive layers 330 disposed on a second region of the resistive material 310, and a third region of the resistive material 310 at an opposing end from the second region of the resistive material 310. The first set of one or more conductive layers 330 may be, for example, copper (Cu), copper-titanium-tungsten (CuTiW), and/or the like. A second set of one or more conductive layers 340 are disposed on the first set of one or more conductive layers 330, a fourth region of the resistive material 310 between the insulative material 320 and the first set of one or more conductive layers 330 on the second region of the resistive material 310, and a fifth region of the resistive material 310 between the insulative material 320 and the first set of one or more conductive layers 330 on the third region of the resistive material 310 at the opposing end from the second region of the resistive material 310. The second set of one or more conductive layers 340 may be, for example, a layer of nickel and then a layer of tin disposed on the layer of nickel. The final outer layer 350 should consist of a solderable surface of tin, or a wire bondable layer of gold, or the like.

The resistor has a predetermined form factor, such as an industry standard or customer specific surface mount resistor package size. Common sizes for surface mount resistors may range between 0.50 by 0.25 millimeters (mm) and 6.40 by 3.20 mm. The geometry may also be reversed and may range between 0.25 by 0.50 mm and 3.20 by 6.50 mm. The resistor may have a value that ranges between 100 micro-Ohms (μΩ) and 10 Ohms (Ω).

Figure 14:
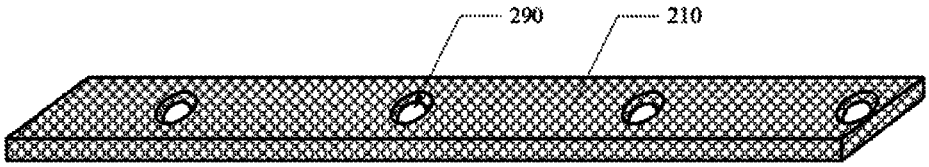
FIGS. 14-16 show perspective views at various stages of manufacturing of the resistor, in accordance with embodiments of the present technology.
Figure 15:
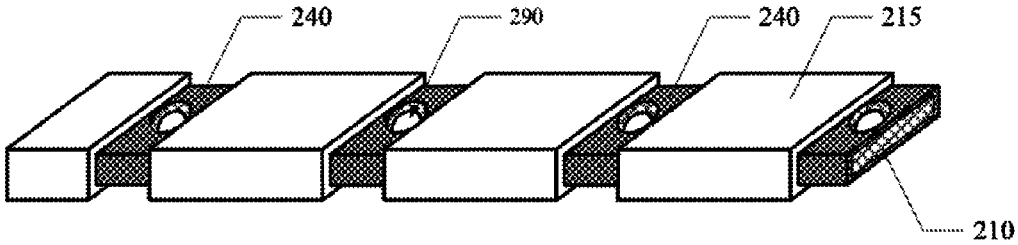
Figure 16:
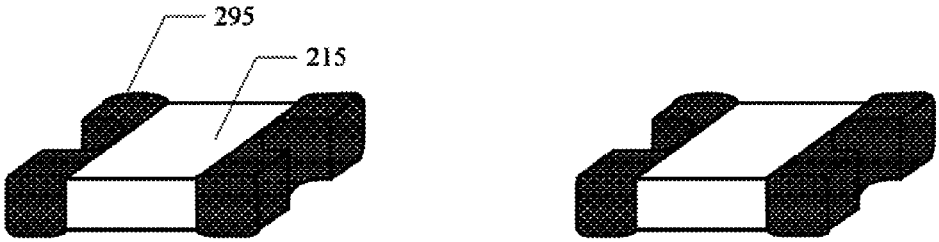

Referring now to FIGS. 14-16 perspective views at various stages of manufacturing of the resistor, in accordance with other embodiments of the present technology, is shown. The resistive material 210 may alternatively include a plurality of holes 290 spaced along the length, as illustrated in FIG. 14. The processes and structures are substantially similar to those described above with regard to FIGS. 1-2 and 3-12. The insulative material 215 is selectively removed in a pattern to expose portions of the resistive material 210 about each of the plurality of holes 290 in the resistive material 210, as illustrated in FIG. 15. After depositing the second set of one or more additional conductive layers, resistors devices having four terminations 295 are formed, as illustrated in FIG. 16.

Each resistor formed according to the above described method includes terminations on opposing ends. The terminations are advantageously deposited in the transverse direction on a continuous strip of resistive material. The body of the resistor is insulated and the terminations are solderable, wire bondable, or the like. Embodiments of the present technology advantageously results in a very high utilization of materials, particularly when the resistive material is not removed to increase the resistance. The coating method for applying the insulative material may advantageously be done in a continuous method covering all four side of the resistive material.

Embodiments of the present technology use laser etching, abrasive machining or the like to expose resistive material to make an area to form conductive pads. This allows for very precise control of insulative coverage as coating definition becomes a subtractive process instead of the normal additive process.

Embodiments of the present technology also use laser etching, abrasive machining or the like to define the final resistance value of the resistor by changing the coating length of the material between the terminations. This again allows for very precise control of insulative coverage as coating definition becomes a subtractive process instead of the normal additive process. Alternatively or in addition, laser etching, abrasive machining or the like can be used to define the final resistance value of the resistor by removing a cross-section portion of the resistive material between the terminations. Accordingly, the resistance value of the resistor can be changed very easily using laser etching, abrasive machining or the like. In addition, the techniques for making a final adjustment of the resistance value advantageously do not change the outside dimension of the resistors, which may be unacceptable by some customers that want a consistent part size. The constant overall part dimension may also improve automated test/package equipment handling.

The foregoing descriptions of specific embodiments of the present technology have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the present technology and its practical application, to thereby enable others skilled in the art to best utilize the present technology and various embodiments with various modifications as are suited to the particular use contemplated. It is intended that the scope of the invention be defined by the claims appended hereto and their equivalents.

What is claimed is:

1. A method comprising:

covering a resistive material with a layer of insulative material;

removing portions of the insulative material from the resistive material in a pattern based on a predetermined approximate dimension and a predetermined approximate resistance value;

depositing a first set of one or more conductive layers on the portions of the resistive material exposed by the patterned insulative material to form a plurality of conductive pads on the resistive material between the patterned insulative material;

measuring a resistance between each set of conductive pads;

removing, for each set of conductive pads, a calculated amount of additional insulative material to correspondingly expose additional portions of the resistive material adjacent the given conductive pads based upon the measured resistance between each set of conductive pads; and depositing a second set of one or more conductive layers on the first set of one or more conductive layers and the exposed additional portions of the resistive material.

2. The method according to claim 1, wherein the resistive material has a desired resistivity and a predetermined cross sectional dimension.

3. The method according to claim 1, wherein the insulative material on the resistive material has a substantially uniform thickness along one or more of the lengthwise sides of the resistive material.

4. The method according to claim 1, wherein the insulative material exhibits good adhesion to the resistive material and is also readily removable from the resistive material.

5. The method according to claim 1, wherein:

the resistive material includes a plurality of holes along the resistive material; and wherein the portions of the insulative material are removed from the resistive material in the pattern about the plurality of holes in the resistive material.

6. The method according to claim 1, further comprising:

removing a section of each part of the patterned insulative material and a calculated amount of a section of the resistive material under the removed section of each part of the patterned insulative material; and re-insulating the exposed resistive material under the removed section of each part of the patterned insulative material.

7. The method according to claim 1, further comprising cutting through the first set of one or more conductive layers and the resistive material to form a plurality of pieces, each piece including portions the first set of one or more conductive layers on opposing ends.

8. The method according to claim 1, wherein covering the resistive material with a layer of insulative material is performed in a continuous method on a length of the resistive material.

9. The method according to claim 1, wherein removing portions of the insulative material from the resistive material is performed in a continuous method on a length of the resistive material.

10. A method of manufacturing a plurality of resistors comprising:

forming one or more layers of insulative material on a resistive material;

removing portions of the one or more layers of insulative material from the resistive material in a pattern based on a predetermined dimension and a predetermined resistance value;

forming a first set of one or more conductive layers on the portions of the resistive material exposed by the insulative coating to form a plurality of conductive pads on the resistive material between the patterned insulative coating;

probing sets of conductive pads to measure a preliminary resistance value between the sets of conductive pads;

for one or more sets of conductive pads, removing a calculated amount of additional insulative material adjacent the respective conductive pads based upon the preliminary resistance value between the corresponding set of conductive pads and a final resistance value;

cutting the first set of one or more conductive layers and resistive material at substantially the middle of each conductive pad to form pieces each including a first region of resistive material having insulative material formed thereon, second and third regions of resistive material at opposing ends of each piece having the first set of one or more conductive layers formed thereon, and wherein one or more pieces include fourth and fifth regions of exposed resistive material between the first region of resistive material having insulative material formed thereon and the second and third regions of resistive material at opposing ends of each piece having the first set of one or more conductive layers formed thereon; and forming a second set of one or more conductive layers on the first set of one or more conductive layers at opposing ends of each piece, and the fourth and fifth regions of exposed resistive material of one or more pieces.

11. The method of manufacturing resistors according to claim 10, wherein the resistive material has a substantially uniform predetermined cross sectional dimension and a substantially uniform predetermined resistivity.

12. The method of manufacturing resistors according to claim 10, wherein the insulative material formed on the resistive material has a substantially uniform thickness along one or more of the lengthwise sides of the resistive material.

13. The method of manufacturing resistors according to claim 10, wherein forming the first set of one or more conductive layers comprises sputtering at least a first metal or metal alloy on the portions of the resistive material exposed by the patterned insulative material, wherein the first metal or metal alloy is characterized by having good adhesion to the resistive material.

14. The method of manufacturing resistors according to claim 10, wherein forming the second set of one or more conductive layers comprises plating with at least a final metal or metal alloy characterized by providing a solderable or wire bondable contact.

15. The method of manufacturing resistors according to claim 10, further comprising:

for one or more others sets of conductive pads, removing a section of the patterned insulative material and a calculated amount of a section of the resistive material under the removed section of patterned insulative material based upon the preliminary resistance values between the corresponding other set of conductive pads and the final resistance value; and re-coating the exposed section of the resistive material with insulative material.

* * * * *